US009644883B2

(12) United States Patent
Lee et al.

(10) Patent No.: US 9,644,883 B2
(45) Date of Patent: May 9, 2017

(54) FLUIDIZED BED CONVEYOR BELT FREEZER SYSTEM

(71) Applicant: GEA Refrigeration Canada, Inc, Richmond (CA)

(72) Inventors: Brian H. Lee, Delta (CA); Felix M Lee, Richmond (CA); Lars I. Johannson, Mukilteo, WA (US)

( * ) Notice: Subject to any disclaimer, the term of this patent is extended or adjusted under 35 U.S.C. 154(b) by 306 days.

(21) Appl. No.: 14/046,540

(22) Filed: Oct. 4, 2013

(65) Prior Publication Data

US 2014/0096543 A1 Apr. 10, 2014

Related U.S. Application Data

(60) Provisional application No. 61/709,526, filed on Oct. 4, 2012.

(51) Int. Cl.
*F25D 13/06* (2006.01)

(52) U.S. Cl.
CPC ..... *F25D 13/06* (2013.01); *F25D 13/067* (2013.01)

(58) Field of Classification Search
CPC ..... F25D 13/06; F25D 13/067
See application file for complete search history.

(56) References Cited

U.S. PATENT DOCUMENTS 3,139,739 A * 7/1964 Robinson ..... A23B 7/0408 62/303
3,201,951 A * 8/1965 Robinson ..... A23L 3/361 62/272
4,301,659 A * 11/1981 Martin ..... A23L 3/361 62/57
4,858,445 A * 8/1989 Rasovich ..... F25D 13/06 62/332
5,447,040 A * 9/1995 Rothstein ..... F25D 25/04 62/303
7,823,409 B2 * 11/2010 Colding-Kristensen A23L 3/362 62/380
2010/0199703 A1 * 8/2010 Ziegler ..... A23L 3/361 62/380

FOREIGN PATENT DOCUMENTS

CA CN202032833 U * 11/2011 ..... A23L 3/36
CN 202032833 U * 11/2011
HU WO 2005073649 A1 * 8/2005 ..... A23B 4/062

* cited by examiner

*Primary Examiner* — Emmanuel Duke
(74) *Attorney, Agent, or Firm* — Dean A. Craine

(57) ABSTRACT

A fluidized bed conveyor belt freezer system including at least one wire mesh conveyor belt in a freezer housing with a plurality of coil arrays and centrifugal fan assemblies that produce a high volume of cold air directed directly upward to a plurality of adjustable vanes mounted under the belt. The vanes are longitudinally aligned and evenly distribute the volume of cold air through the conveyor belt to efficiently fluidize, freeze the product transported on the conveyor belt. The volume of cold air in the fan chamber is produced by a plurality of fan assemblies that draw cold air from the coils, uniformly mixed and delivered to the entire length of the bottom of the conveyor belt. The vanes are adjusted to distribute the cold air in the fan chamber through the conveyor belt to prevent blowouts. The fan motors are mounted externally on the freezer housing for easier servicing.

8 Claims, 5 Drawing Sheets

FLUIDIZED BED CONVEYOR BELT FREEZER SYSTEM

This utility patent application is based on and claims the filing date benefit of U.S. provisional patent application (application Ser. No. 61/709,526) filed on Oct. 4, 2012.

COPYRIGHT NOTICE

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

The present invention pertains to freezers that transport food products on a conveyor belt inside the freezer, and more particularly, to freezers that use fluidized beds that simultaneously freeze and transport the product.

2. Description of the Related Art

Fruits and vegetables are commonly process in large industrial freezers with conveyor belts that carry the product through various freezing zones inside the freezer. Ideally, when the fruit or vegetable products travel through the freezer and reach the end of the conveyor belt, the individually pieces of fruit or vegetable products are frozen with little or no damage.

Some fruits, such as raspberries, blackberries, and marionberries, are soft when ripe, can be easily squished or destroyed when processing. The berries are made up of small pieces, called drupelets that easily detached from the berry when handled reducing the berry's size.

In the prior art, freezer conveyor belts have been used to process raspberries, blackberries and marionberries. Typically, the location where the berries enter the conveyor belt, commonly known at the 'wet zone', is where the berries are soft, stick together, and most susceptible to damage. While in the wet zone, the berries are submerged in a liquid nitrogen bath which 'crust freezes' the berries. After leaving the liquid nitrogen bath, the berries are then deposited onto a fluidized bed conveyor belt where they undergo further freezing.

The cost of liquid nitrogen is very expensive. Also, on a fluidized bed conveyor belt, the velocity of the cold air delivered directly into the belt is often irregular creating violent 'blowout holes' in the fluidized layer of berries that damage to the berries. Sometimes, the 'blowout holes' are relatively large and interfere with the fluidizing process.

What is needed is an improved freezer conveyor belt system that is more efficient in cooling product transported on a fluidizing bed conveyor belt that does not require using liquid nitrogen, and reduces the occurrence of 'blowout holes' in the fluidized bed.

SUMMARY OF THE INVENTION

At the heart of the invention is the discovery that damage to fresh bulk product, such as fruit, when processed in a freezer with a fluidized bed conveyor belt is caused by uncontrolled 'blowout holes' in the fluidized bed conveyor belt. Also at the heart of the invention is the discovery that uncontrolled 'blowouts holes' may be reduced by creating a volume of cold air in the fan chamber located under the conveyor belt that has a uniform velocity and temperature, and which is then delivered to the belt using vanes that control the direction and volume of cold air through different regions of the conveyor belt. It was discovered that when soft, fragile product is placed on a fluidized bed conveyor belt, producing a large volume of cold air that has a uniform low temperature in the fan chamber and then evenly distributing cold air through the conveyor belt near the freezer's ingress opening, reduces the size of the 'wet zone' which leads to less product damage.

The above objectives are met by the improved fluidized bed conveyor belt freezer system disclosed that includes at least one wire mesh conveyor belt located above the fan chamber formed in an elongated freezer. The fan chamber includes a plurality of fan assemblies that draw cold air through a plurality of coil arrays. The cold air from the coil arrays is mixed in the fan chamber and directed upward into a plurality of air deflection vanes mounted under the conveyor belt. The vanes are longitudinally aligned under the conveyor belt to evenly distribute the flow of cold air over the bottom surface and through the conveyor belt. Because the cold air in the fan chamber is mixed cold air from the fan assemblies and coil arrays, the cold air has a substantial uniform temperature and velocity. By evenly distributing the uniform the cold air across and along the bottom surface of the conveyor belt, the fluidization process on the top surface of the conveyor belt is optimized and the formation of large 'blowout holes' that can damage product is reduced. Also because the freezer includes a unique freezer housing and unique arrangement of coil arrays and fan assemblies, the overall efficiency of the system is enhanced.

The freezer housing has a large closed chamber in which at least one conveyor belt is located. The conveyor belt extends horizontally through the closed chamber creating an upper chamber area and a lower chamber area. In the lower chamber area is a plurality of coil arrays and fan blade assemblies. Each fan blade assembly draws air horizontally over the coils on the adjacent coil array and delivers it upward towards the upper chamber area and towards the bottom of the conveyor belt. Located immediately above each fan blade assembly is a set of adjustable vanes that evenly distribute the flow of cold air from the fan blade assembly across and along the entire bottom surface of the conveyor belt to fluidize the product.

Each fan blade assembly has three elongated adjustable vanes in the space located between the fan blade assembly and the conveyor belt. In one embodiment presented, each fan blade assembly is assigned to one set of vanes. It should be understood however, that large vanes may extend over multiple fan blade assemblies or the entire length of the belt. Also in the embodiment shown, each angle or pitch of each vane may be selectively adjusted and locked in fixed angle so that the desired about of fluidization is occurring.

Because no partitions or barriers are placed between the coil arrays, the volumes of cold air from adjacent coil arrays are mixed together to create a uniform volume of cold air in the fan chamber.

The freezer can created a fluidized product zone without the use of a pressure distribution perforated plate commonly used underneath a fluidized bed conveyor belt used in the prior art.

The freezer with an offset front surface creates an area for the fan assemblies and an upper fan chamber located under the conveyor belt.

The vanes located underneath the conveyor belt enables operators to adjust the airflow to fine tune the flow pattern for the product.

A large fan chamber allows cold air to mix and allows cold air to be drawn from adjacent coils.

Placement of the fans directly underneath the product zone creates a high pressure area directly beneath the belt normally only achieved using a centrifugal blower.

The freezer housing also has an efficiency design by including a front wall in an offset configuration so the fan motors are mounted outside of the freezer housing.

DESCRIPTION OF THE PREFERRED EMBODIMENT(S)

Figure 1:
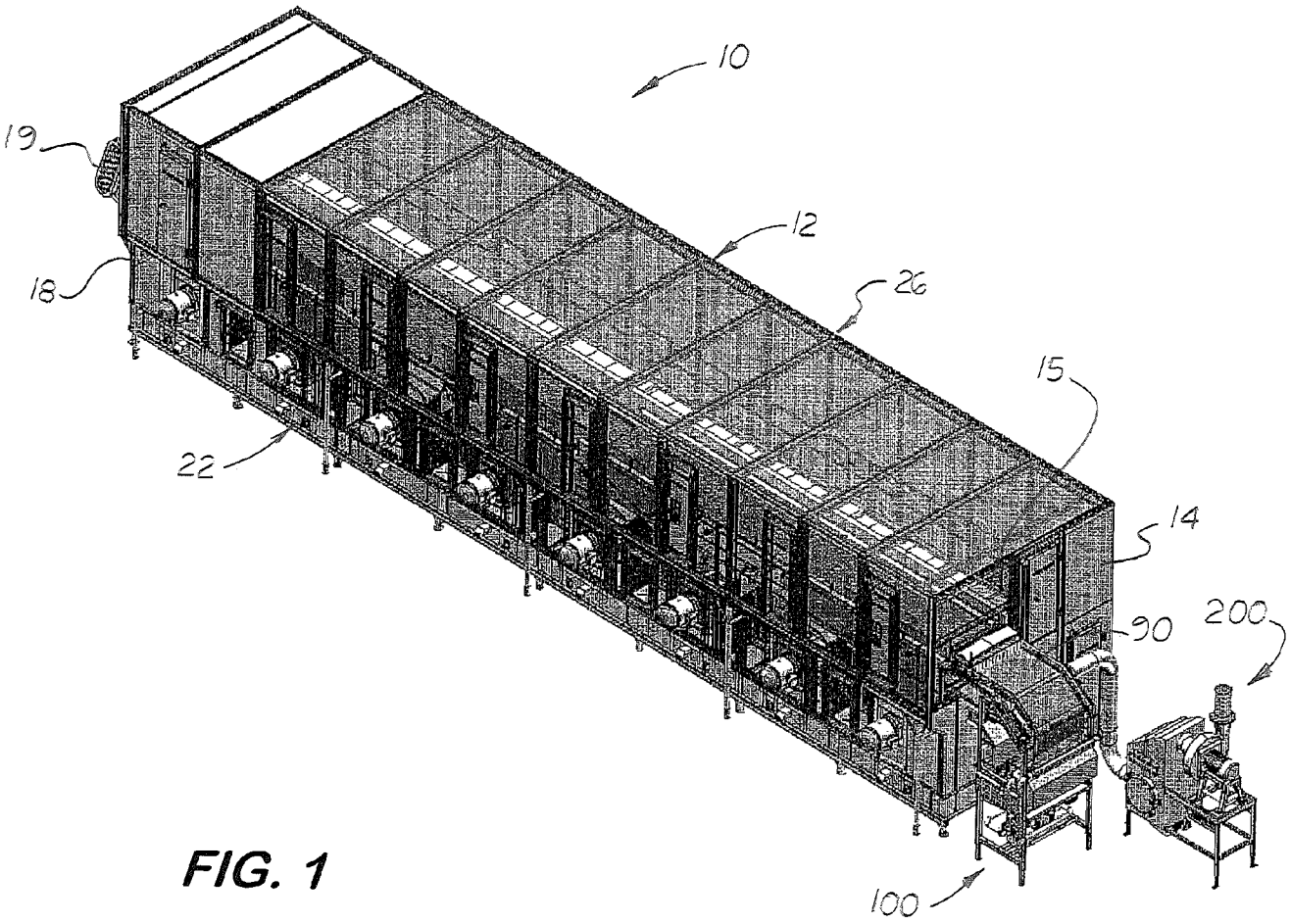
FIG. 1 is a perspective view of the improved fluidized bed conveyor belt freezer system.

Referring to the accompanying FIGS. 1-8, there is shown improved fluidized bed conveyor belt freezer system 10 that includes a large, rectangular freezer housing 12 in which at least wire mesh conveyor belt 90 is longitudinally aligned. The conveyor belt 90 is configured to carry loose bulk product 5 longitudinally inside the freezer housing 12. Located under the conveyor belt 90 is a plurality of side-by side coil arrays 60 used to continuously produce below cold air 8 as a temperature sufficient to freeze the product 5 as it travels on the conveyor belt 90. Each coil array 60 is located adjacent to a fan blade assembly 72 with an externally mounted motor 70. The fan blade assemblies 72 are placed side-by-side inside a fan chamber.

The freezer housing 12 is a closed rectangular structure two end panels 14, 18, a dual face front panel 22, a rear panel 26, a top panel 32 and a bottom panel 36. Formed on the end panels 14, and 18 are ingress and egress openings 15, 19, respectively, that allows product 5 to enter and leave the freezer housing 12. In the embodiment shown in the Figs, the wire mesh conveyor belt 90 extends longitudinally inside the freezer housing 12 between the ingress and egress openings, 15, 19. It should understood however, that other freezer designs may be developed that use more than one fluidized bed conveyor belt 90. Located near the ingress opening 15 is an in-feed mechanism 200 and located near the egress opening 19 is an out-put mechanism 202.

The product 5 is deposited in an area on the conveyor belt 90 known as the 'wetzone' where it is immedially exposed to uniformly cold and high pressure air. The coil arrays 60 and fan blade assemblies 72 mentioned above are located directly under the 'wetzone'. In the embodiment presented herein, a plurality of the coil arrays 60 and the fan blade assemblies 72 are used along the entire length of the conveyor belt 90.

Figure 2:
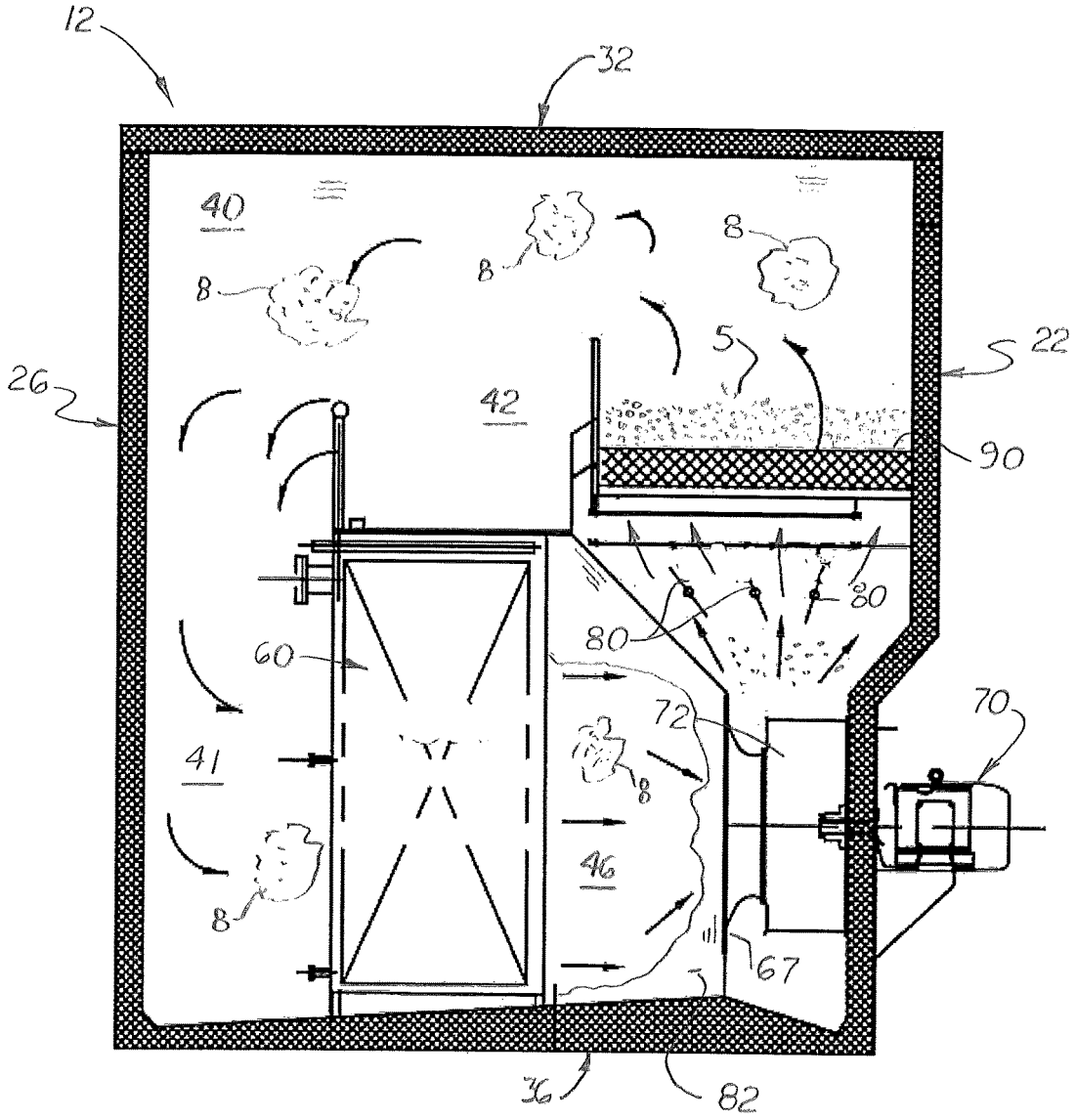
FIG. 2 is a section end view of the freezer housing shown the relative locations of the fan motor, the fan blade assembly, the adjustable vanes, the conveyor belt, and the coil array and the direction of cold air flow during operation.
Figure 3:
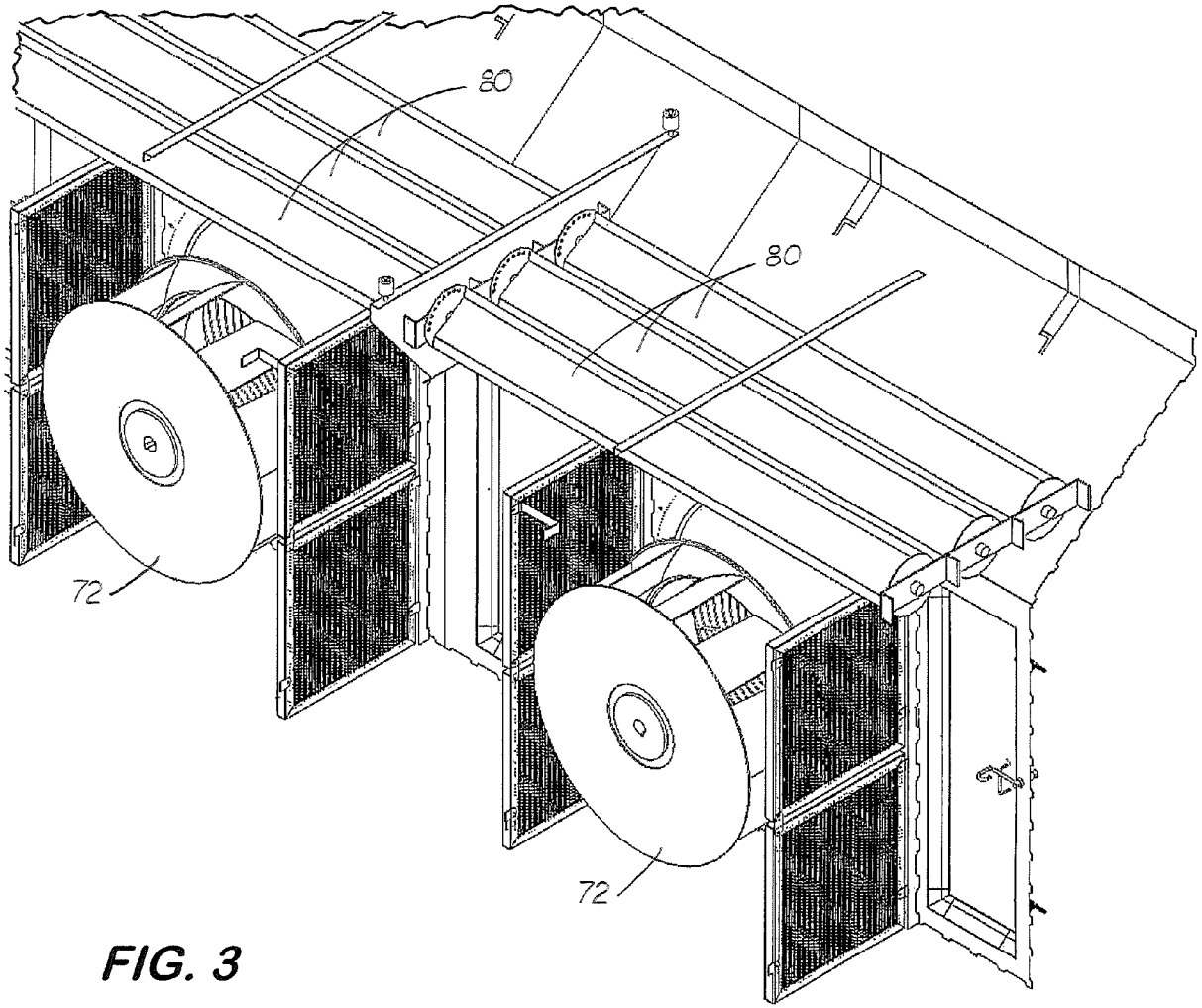
FIG. 3 is a perspective view of two fan blade arrays each in the freezer housing and under three adjustable vanes with the conveyor belt removed.

As shown in FIG. 2, the coil arrays 60 are mounted on the inside surface of the bottom panel 36. The coil arrays 60 are transversely aligned so cold air 8 circulates inside the housing 12 in a top-to-bottom, and back-to-front directions. In front of each coil array 60 is an optional plenum 82 that directs cold air 8 from the coil array 60 to a centrifugal fan blade assembly 72 directly in front of the coil array 70. The plenum 82 may be one large continuous structure that extends the entire length of the freezer or it may be smaller structures designed to extend only in front of an adjacent coil array.

Spaces or air gaps 67 may be created between the plenum 82 and the fan blade assemblies 72 so cold air 8 from adjacent coil arrays 60 may be shared and mixed together. Ideally, each fan blade assembly 72 is configured to draw cold air 8 through the adjacent or nearby coil arrays 60 and force the cold air 8 upward into the upper section of the fan chamber 46 towards the conveyor belt 90. The cold air 8 travels through the conveyor belt 90 and collects in the upper chamber area 42 and re-circulated into the lower coil chamber 41

Located above fan blade assembly 72 and below the conveyor belt 80 are at least three longitudinally aligned air deflection vanes 80 designed to redirect portions of the cold air 8 delivered to the fan chamber 46 towards three longitudinal sections on the belt 90. In the preferred embodiment, the vanes 80 are equally spaced apart and longitudinally aligned under the conveyor belt 90 to evenly distribute the flow of cold air 8 through the conveyor belt 90 to efficiently fluidize and freeze product 5 transported on the belt 90 with minimal waste. Because the vanes 80 efficiently divide and distribute the large volume of cold air 8 through the conveyor belt 90, the 'wet zone' is relative small compared to other fluidizing belts.

The fan motors 70 are externally mounted on the front panel 22 that allows for easy access. The fan blade assemblies 72 are closely mounted under the conveyor belt 90 providing high velocity and high pressure that lifts and fluidizes the product 5. Because greater surface area of the product 5 is exposed, the product is quickly cooled and frozen.

In the preferred embodiment, the upper section of the fan chamber 46 located between the fan blade assembly 72 and the belt 90 is confined and equally divided by the vanes 80 so the volume of cold air 8 that flows into the upper section is equally divided and shared by the three vanes 80. In the preferred embodiment, the angle of the vanes 80 relative to the conveyor belt 90 may be adjusted according to the size, shape, and weight of the product 5 and the tumbling or fluidization needed.

Figure 4:
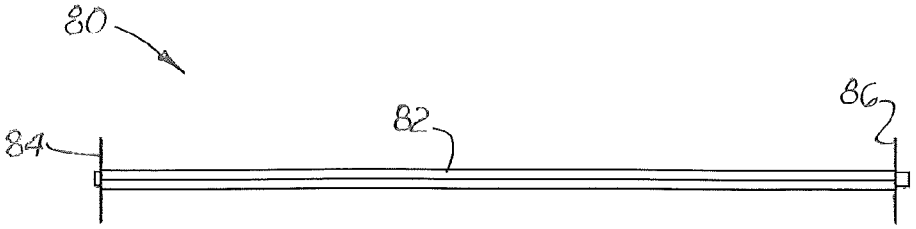
FIG. 4 is a front elevation view of an adjustable vane.
Figure 5:
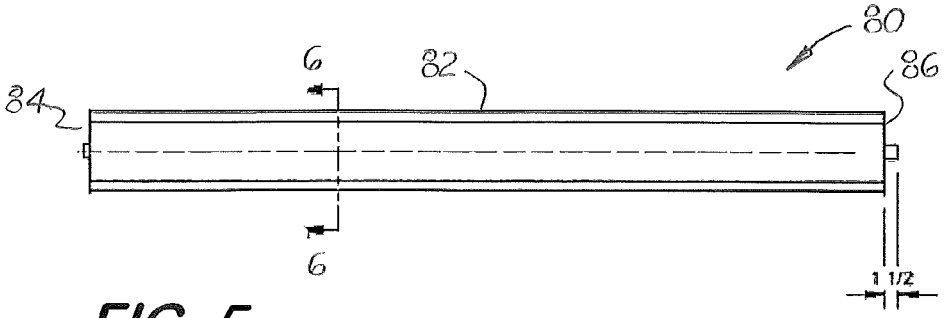
FIG. 5 is a top plan view of an adjustable vane.
Figure 6:
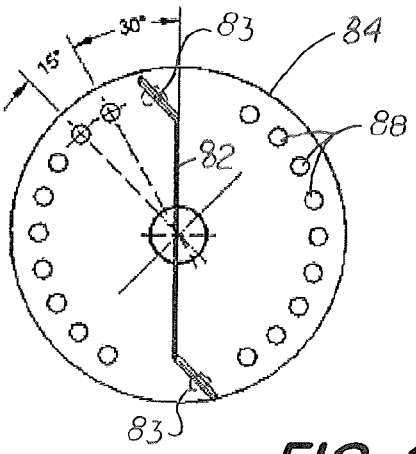
FIG. 6 is a sectional side elevational view of the vane take along line 6-6 in FIG. 5.

As shown in FIGS. 4 and 5, each vane 80 includes an elongated planar member 82 with two outward extending axles that engage the two fixed circular end plates 84, 86. The two circular end plates 84, 86 are affixed to a substructure (not shown) located under the conveyor belt 90. A plurality of holes 88 are formed on each end plate 84 and, 86 that received pegs 83 attached to the tips of the planar member 82 that enable the user to rotate the planar member 82 in between the two end plates 84, 86 and adjust the flow of cold air 8 delivered to the conveyor belt 90. Because each fan blade assembly 72 is used with one set of vanes 80 located immediately above it, the vanes 80 are longitudinally aligned with the entire conveyor belt 90 ensuring a consistent freezing quality across the length of the conveyor belt 90.

During operation, the product 5 is loaded horizontally onto the conveyor belt 90. Upon entry, the product 5 is blasted with high pressure cold air 8 in conjuction with gentle mechanical vibration provided by the conveyor belt 90 to lift and tumble the product 5. The product 5 is then fluidized along the entire length of the conveyor belt 90 and then discharged out the egress opening 19.

Also provided is a continuous belt washing and drying system 100 is used to constantly clean and dry the conveyor belt 90 to the touch, so incoming product 5 lands on a moisture free or dry belt 90. This continuous washing of the conveyor belt 90 is required for the operation of the belt, otherwise product 5 may stick onto the conveyor belt 90 limiting the fluidization. Drying of the conveyor belt 90 is achieved with a single pass, as the dual blower that use an air knife to create a vortex that dries the conveyor belt 90.

Figure 7:
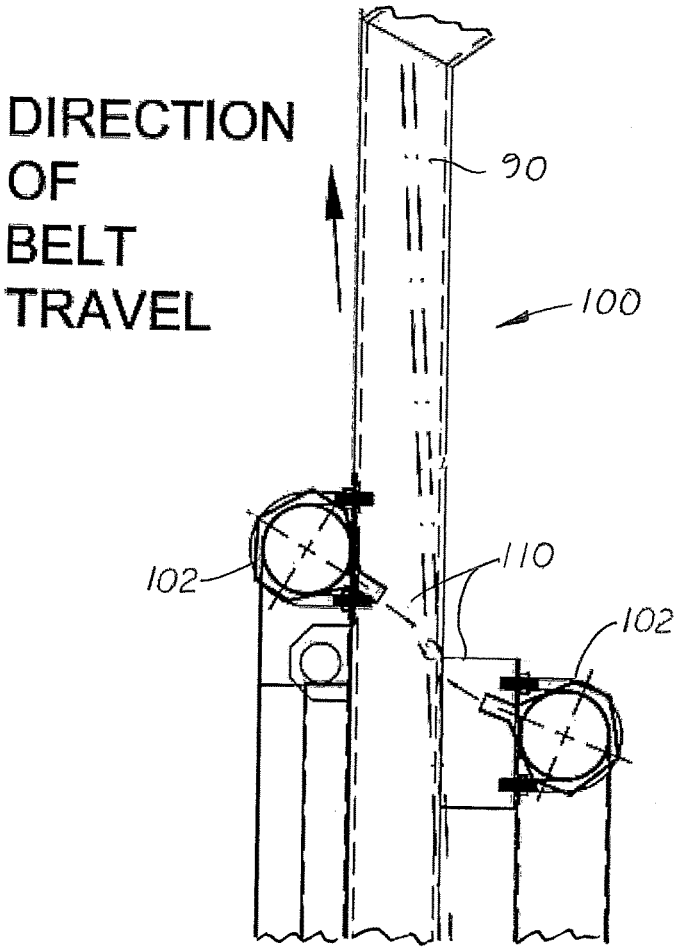
FIG. 7 is an illustration showing the two blower motors located along opposite sides of the conveyor belt and positioned at an offset alignment creating a vortex that thoroughly dries the conveyor belt.
Figure 8:
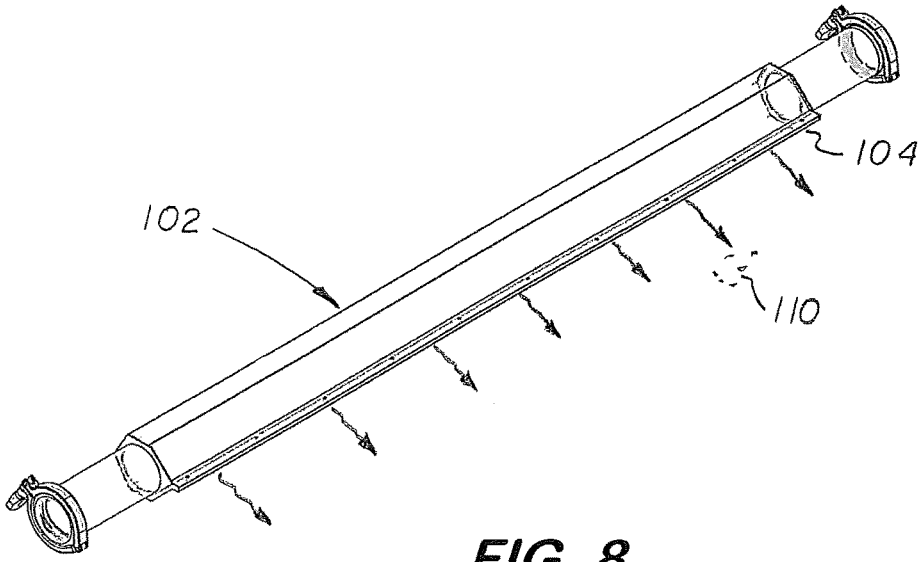
FIG. 8 is a top perspective view of a blower used in the drier.

FIG. 7 is an illustration showing the two blower motors 102 located along opposite sides of a vertically aligned section of the belt 90. As shown more clearly in FIG. 8, the two blower motors 102 each include a thin, elongated nozzle 104 that blows a narrow, high velocity stream of air 110 against the adjacent surface of the conveyor belt 90. The two nozzles 104 are aligned in an offset alignment so that the two streams of air 110 create a vortex that thoroughly dries the conveyor belt 90.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

We claim:

1. A fluidized bed conveyor belt freezer system, comprising:

a. a freezer housing that includes an upper chamber, a fan chamber, and a coil chamber;

b. at least one wire mesh conveyor belt located inside said freezer housing between said upper chamber and said fan chamber, said conveyor belt includes a bottom surface and a top surface configured for tranporting product in a fluidized bed inside said freezer housing;

c. a plurality of coil arrays located inside said coil chamber and configured to produce sufficiently cold air to a desired temperature to freeze a product placed on said top surface of said conveyor belt;

d. a centrifugal fan blade assembly located inside said fan chamber and adjacent to each said coil array, said centrifugal fan blade assembly being configured to draw and mix cold air from said coil arrays and forcibly deliver said cold air upward in said fan chamber and directly towards said bottom surface of said conveyor belt, each said fan blade assembly being coupled to a motor located outside said freezer housing; and, e. a plurality of elongated, longitudinally aligned vanes located below said bottom surface of said conveyor belt, said vanes being parallel and aligned at different angles to evenly distribute cold air from said centrifugal fan blade assembly over said bottom surface and through said conveyor belt, each said vane includes an elongated planar member that selectively rotates to adjust the flow of said cold air delivered to said conveyor belt, each said vane configured to be held at a fixed angle to allow cold air to flow uniformly through said conveyor belt to fluidize the product located on said top surface of said conveyor belt and minimize blowouts.

2. The system as recited in claim 1, wherein each said centrifugal fan assembly includes a motor that is externally mounted on said freezer housing.

3. The system, as recited in claim 1, further including a belt washing and drying system.

4. A fluidized bed freezer system comprising a freezer housing, a wired conveyor belt located inside said freezer housing and configured to transport a product to be frozen using a fluidized bed created by blowing sufficiently cold air upward through said conveyor belt, a plurality of parallel vanes each with a planar member aligned longitudinally with said conveyor belt and located under said conveyor belt, said vanes being configured to selectively rotate to control velocity and volume of the cold air through said conveyor belt and reduce blowouts in said fluidized bed, a cold air generating system, and at least one fan assembly located adjacent to said cold air generating system and under said conveyor belt, said fan assembly mixes and transmits cold air from said cold air generating system and transmitted upward directly over said vanes and through said conveyor belt to fluidize the product.

5. The system as recited in claim 4, wherein said vanes are adjustable and may be fixed at different angles with respect to said conveyor belt enabling an operator to adjust the fluidization of the product and prevent blowouts on said conveyor belt.

6. The system, as recited in claim 4, further including a belt washing and drying system.

7. The system, as recited in claim 4, wherein said fan assembly is a centrifugal fan blade assembly.

8. A method for reducing blowouts on a fluidized bed conveyor belt used to transport product in a freezer, comprising:

generating a volume of high velocity, cold air sufficient to freeze and fluidize a product placed on a fluidized bed conveyor belt operating inside a freezer used to freeze product, said volume of cold air being produced by a plurality of coil arrays and a plurality of centrifigul fan assemblies located in a fan chamber located insaid said freezer, said fan assemblies configured to directly deliver at sufficiently high velocity and at sufficiently high volume of cold air to a set of adjustable vanes to fluidized product on said conveyor belt, said vanes are aligned longitudinally and under said conveyor belt and configured to redirect and divide said cold air delivered to the conveyor belt into smaller volumes to optimize fluidization of the product and prevent blowouts;

delivering a sufficient amount of volume of high velocity cold air to said vanes to fluidized said product located on said conveyor belt; and, adjusting the angle of each said vane to divide said cold air delivered to said vanes into equal size smaller volumes and directing said smaller volumes of cold air directly against said conveyor belt to fluidize product.

* * * * *